US010758056B2

(12) United States Patent
Piispanen et al.

(10) Patent No.: US 10,758,056 B2
(45) **Date of Patent: *Sep. 1, 2020**

(54) SEAT PLACEABLE IN PUBLIC ROOMS

(71) Applicant: GOSLEEP OY, Naarajärvi (FI)

(72) Inventors: Jussi Piispanen, Pieksämäki (FI); esko Koikkalainen, Mänttä (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/726,925

(22) Filed: Oct. 6, 2017

(65) Prior Publication Data

US 2018/0042387 A1 Feb. 15, 2018

Related U.S. Application Data

(62) Division of application No. 14/342,086, filed as application No. PCT/FI2012/000036 on Sep. 3, 2012, now Pat. No. 9,795,222.

(30) Foreign Application Priority Data

Sep. 2, 2011 (FI) ..... 20115865

(51) Int. Cl.
*A47C 17/16* (2006.01)
*A47C 1/024* (2006.01)
(Continued)

(52) U.S. Cl.
CPC ..... *A47C 17/16* (2013.01); *A47C 1/02* (2013.01); *A47C 1/0242* (2013.01);
(Continued)

(58) Field of Classification Search
CPC ..... A47C 17/16; A47C 1/02; A47C 1/0242; A47C 1/0342; A47C 1/13; A47C 7/62; A47C 7/66; A47C 13/00; G07F 17/0021
See application file for complete search history.

(56) References Cited

U.S. PATENT DOCUMENTS 211,844 A * 2/1879 Green et al. ..... A47C 17/52 5/153
2,602,492 A * 7/1952 Fowler ..... G07F 17/08 297/217.3
(Continued)

FOREIGN PATENT DOCUMENTS

ES 2011-N74050 * 11/2011
JP 57-125790 1/1984
(Continued)

OTHER PUBLICATIONS

Japanese Notification of Reasons for Refusal dated Feb. 6, 2019 in Japanese Patent Application No. 2017-207242.

*Primary Examiner* — Robert G Santos
*Assistant Examiner* — Rahib T Zaman
(74) *Attorney, Agent, or Firm* — B. Aaron Schulman; Stites & Harbison PLLC

(57) ABSTRACT

Convertible seat which can be located in public places which seat comprises a seat part (1) and a back rest (3) in which case the back rest (3) can be turned in relation to the seat part (1), mechanism (9) in order to convert the seat essentially into a horizontal plane to become a resting surface, equipment in order to secure the items of the user, equipment in order to collect the use charge and equipment in order to cover the seat which has been converted to become at least a resting surface to become at least a partly closed resting space in which case the equipment in order to cover the resting space comprises a covering device (16) with a standard width which can be moved from the back part of the seat forward which covering device comprises control elements (7) which are installed at the both sides of the seat to such height that a needed resting space is formed underneath the covering device (16). The seat comprises an control unit (27) which is adjusted to recognize the payment of the use charge and which is adjusted to allow the moving
(Continued)

of the seat into a resting space on the grounds of that in which resting space the space (19) for keeping the items of the user is protected and the mentioned resting space can be closed with the covering device (16) and that the control unit (27) is adjusted move the covering device (16) away from the position which closes the resting space with the help of a regulating unit when the paid utilization time has finished.

8 Claims, 6 Drawing Sheets

(51) Int. Cl.

| | |
|---|---|
| ***A47C 7/62*** | (2006.01) |
| ***A47C 7/66*** | (2006.01) |
| ***A47C 1/034*** | (2006.01) |
| ***G07F 17/00*** | (2006.01) |
| ***A47C 1/13*** | (2006.01) |
| ***A47C 1/02*** | (2006.01) |
| ***A47C 13/00*** | (2006.01) |

(52) U.S. Cl.
CPC ..... *A47C 1/0342* (2013.01); *A47C 1/13* (2013.01); *A47C 7/62* (2013.01); *A47C 7/66* (2013.01); *A47C 13/00* (2013.01); *G07F 17/0021* (2013.01)

(56) References Cited

U.S. PATENT DOCUMENTS 3,512,314 A * 5/1970 George ..... A47C 17/38 5/10.1
3,553,911 A * 1/1971 Morrow et al. ..... E04H 1/12 454/251
3,711,878 A 1/1973 George et al.
3,948,379 A * 4/1976 Warner ..... A61H 23/0254 194/307
4,217,012 A * 8/1980 Klaus ..... A47B 55/06 312/111
4,525,884 A * 7/1985 Tolley ..... A47C 17/62 5/284
4,987,706 A * 1/1991 Hughes ..... E04B 1/8218 52/143
5,177,912 A * 1/1993 Ball ..... E04B 1/8218 52/175
5,573,320 A * 11/1996 Shearer ..... A47B 83/02 297/184.14
5,638,646 A * 6/1997 Shane ..... E04H 1/125 235/382.5
5,857,745 A * 1/1999 Matsumiya ..... B60N 2/34 297/354.13
5,954,401 A * 9/1999 Koch ..... B60N 2/242 297/147
2002/0070314 A1* 6/2002 Schmidt-Schaeffer ..... B60N 2/01 244/118.6
2006/0006704 A1* 1/2006 Skelly ..... B60N 2/62 297/188.08
2009/0066121 A1* 3/2009 Jacob ..... A47C 15/00 297/118
2011/0209417 A1* 9/2011 Ma ..... A61H 33/006 52/79.1

FOREIGN PATENT DOCUMENTS

| | | |
|---|---|---|
| JP | 2002-191466 | 7/2002 |
| JP | 2002-283897 | 10/2002 |
| JP | 2003-284623 | 10/2003 |
| JP | 2010-274773 | 12/2010 |

* cited by examiner

SEAT PLACEABLE IN PUBLIC ROOMS

This application is a divisional of U.S. patent application Ser. No. 14/342,086, filed Jun. 27, 2014, which is a 371 application of International Application PCT/FR2012/000036, filed Mar. 9, 2012, all of said applications incorporated herein by reference.

The invention relates to a convertible seat which can be place in public places which seat comprises a seat part and a back rest in which case the seat part can be turned in relation to the seat part when the seat comprises a mechanism for converting the seat essentially into a horizontal plane to become a resting surface, an equipment for securing the items of the user, an equipment for collecting the user charge and an equipment for covering the seat which has been changed at least into a resting surface to become at least a partly closed resting space in which case the equipment for covering the resting place comprises a covering device with a standard width which can be moved from the back part of the seat forward which covering device has control elements at the both sides of the seat being installed at such height that a needed resting space is formed underneath the covering device.

A seat according to the above seen preamble is previously known from a Japanese published application JP 2006061309. A screen relating to the seat which can be converted into a resting surface is shown in the publication which screen is located at the back part of the seat being pulled by a spring and being wound into a roll. The screen can be extracted from the roll to partly cover the seat. The screen can be stiffened by pressurizing it with air. The equipment comprises an operation panel with the help of which operation panel the turning of the seat into a horizontal plane can be made; also the lifting into a sitting position can be made. The screen is quite small because the meaning of it is to cover only the upper part of the person. The screen cannot be bigger because no support for such thing is shown in the presented solution.

The disadvantage of the seat according to the publication JP 2006061309 is a relatively big size but in spite of that the user is protected by only a rather small coverage area which reaches mainly only to cover the face of the person. The body of the user stays mainly uncovered and there is no protected or locked space for the items either. The flexible screen which can be stiffened with air has a quite weak attachment and can thus easily be lifted up at its front edge.

In order to eliminate the above mentioned disadvantages a new, convertible seat has been developed of which it is characteristic what has been shown in the independent claims 1 and 2. Other ways of performance of the invention are shown in the dependent claims.

The advantage of the convertible seat according to the invention is a sufficient protection of privacy which can be achieved when the resting space can be covered at its open upper part with the help of the moveable protection device. Air circulation into the resting space can be arranged in spite of the coverage area through a hole located at the lower part of the seat for example with the help of a material of the covering device which lets the air go through. The seat is electrified and its usage is chargeable. It is also safe to use it when it comprises a storage room which cannot be accessed when the seat is in a resting space. Regarding the user it is also safe that the covering device moves to an open state controlled by the control unit when the paid time finishes. The seat can be located at/in a hall area, at a wall or behind doors which can be opened.

In the following the invention is described more detailed by referring to the accompanying drawings in which FIG. 1 shows a seat from the side as a section view when the side part is removed.

Figure 1:
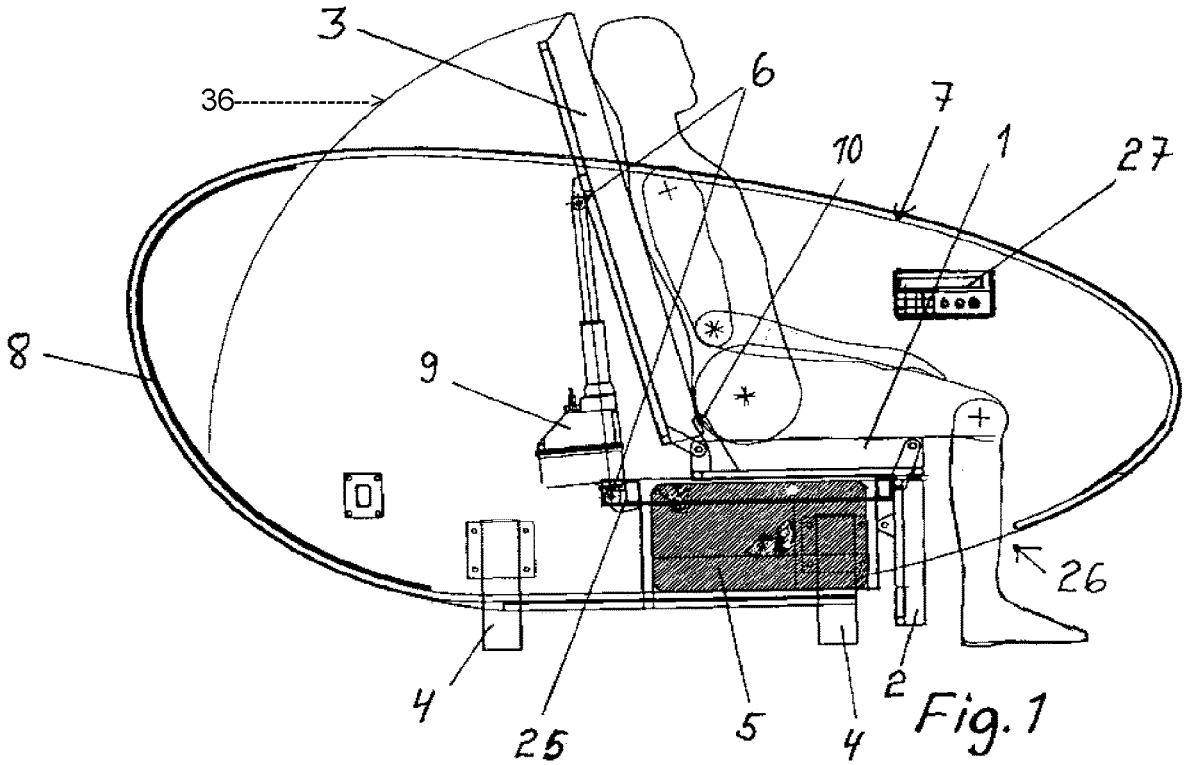

A convertible seat is shown in the FIG. 1 in a sitting position the main parts of which seat can be seen in the FIG. 1. The seat is formed of a seat part 1 and a back rest 3. Additionally it comprises the extension 2 of the seat part 1 which extension turns into horizontal plane when the back rest 3 turns into horizontal plane. The back rest 3 is turned with the help of a mechanism 9 which lengthens/shortens with the help of a motor. The mechanism 9 is attached to the back rest 3 and to the seat body 25 with the help of joint attachments 6. There is a trunk underneath the seat part 1 where the baggage 5 is located. The seat comprises feet 4. There is a groove 7 for the covering device which forms the closed resting space with the help of which groove the covering device can be moved in the back partly underneath the seat while being at an open state and can be moved forward into a closed state in which case the front edge of the covering device reaches till the gap 26. There is a support plate 8 at the back part of the seat which at the same time is the protection of the back part when the covering device has been moved forward into a state which closes the resting space. The control centre 27 is also shown in the FIG. 1 at which there are execution devices of the payment and selecting switches for the functions, for example whether one chooses the turning of the seat into a resting space or whether one wants to have a sitting position or intermediate positions. Headphones and the playing of a radio and/or music can be connected to the control centre 27.

Figure 2:
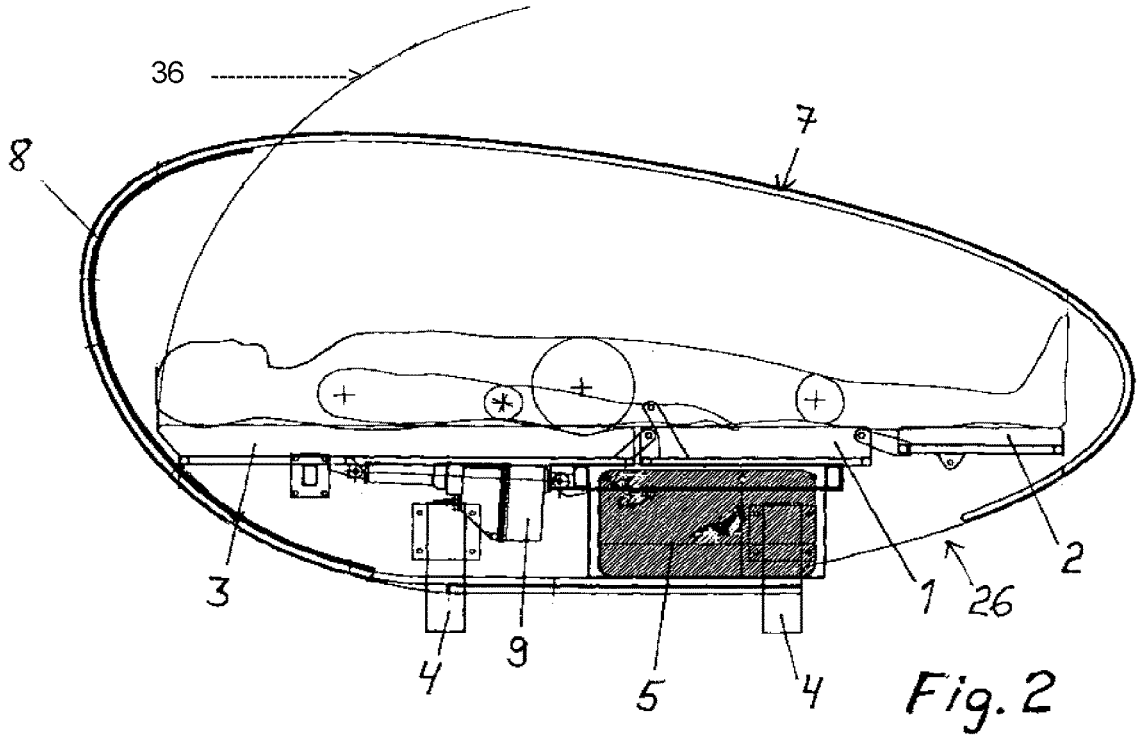
FIG. 2 shows the seat of the FIG. 1 when it has been converted into a resting position.

The seat of the FIG. 1 is shown in the FIG. 2 when being converted into a resting position in which case the back rest 3 moves along are 36 until it has been turned into a horizontal plane when the length of the mechanism 9 has been shortened with the help of the motor. At the same time the extension 2 of the seat part 1 has been turned into horizontal plane. The covering device is in the groove 7 and covers the area above the seat from the gap 26 to the plate 8.

Figure 3:
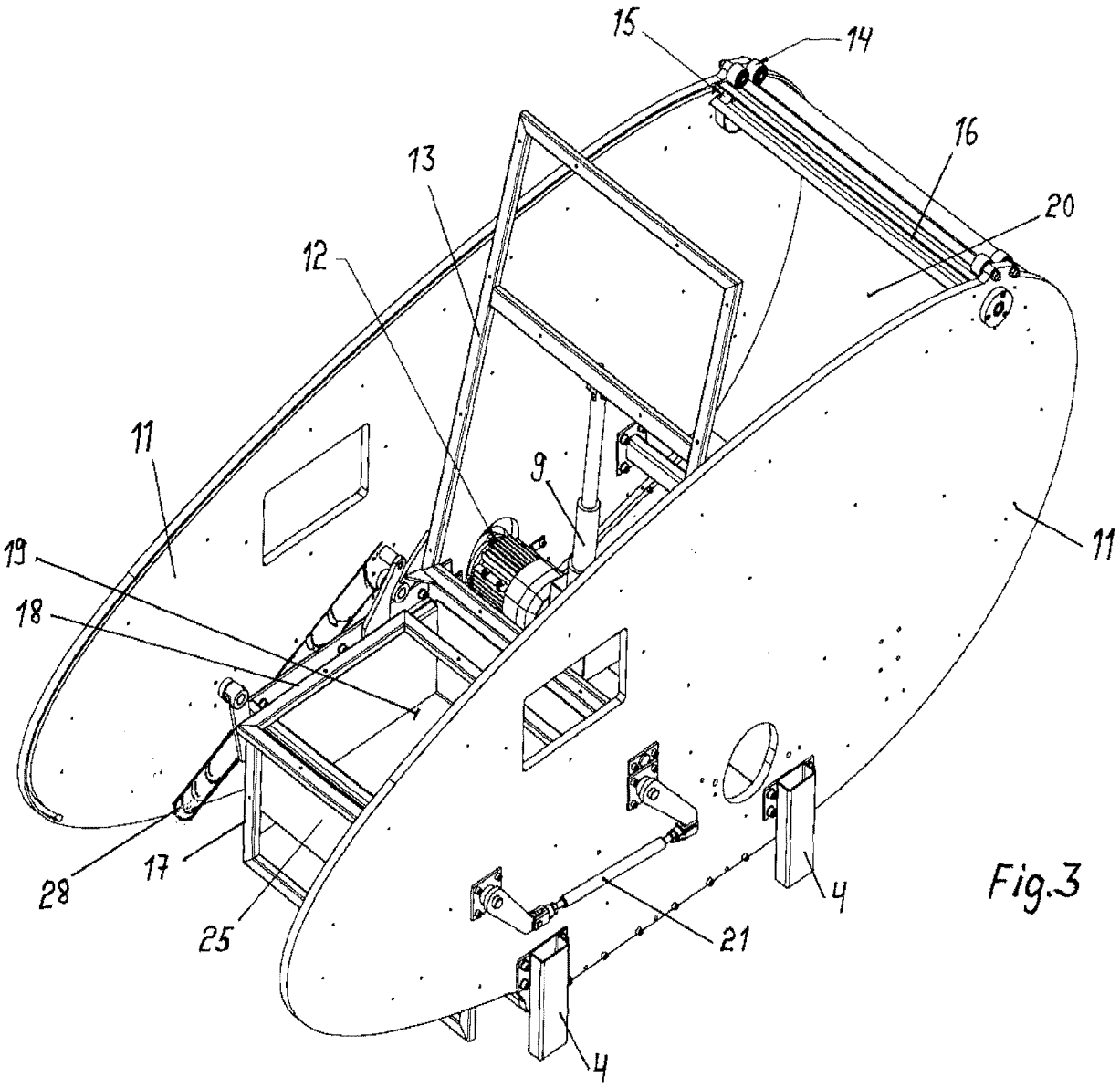
FIG. 3 shows the body parts of the seat diagonally seen.
Figure 4:
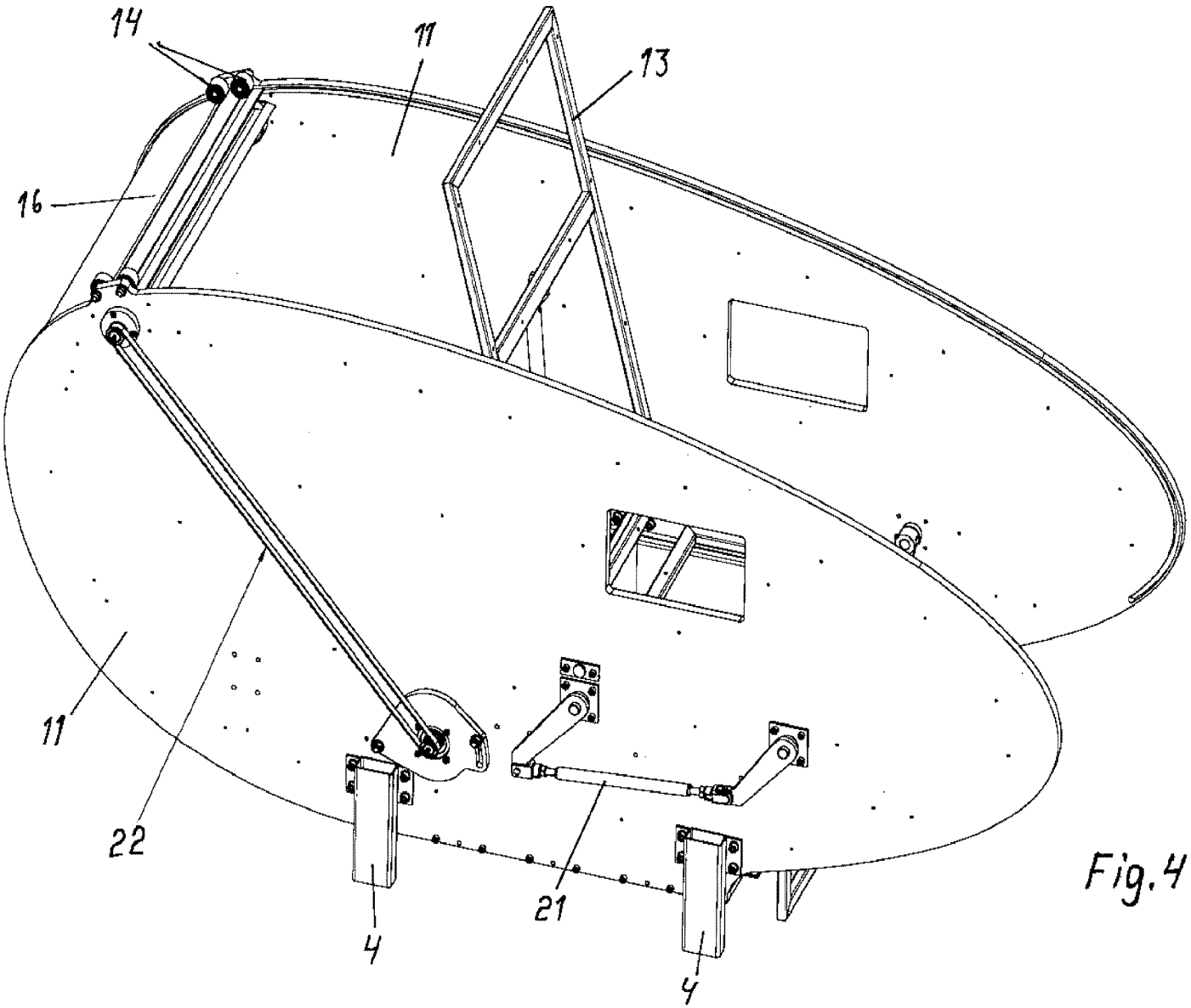
FIG. 4 shows the body parts of the seat seen from the opposite side.

The body parts of the seat are shown in the FIGS. 3 and 4 in which case the vertical plate elements 11 function as side bodies located at a distance from each other. The plate elements 11 are attached to each other at their lower part with the help of a fixed seat body 25. The body 18 of the seat part 1, the body of the back rest 3 and the body 17 of the extension of the seat part 1 are moveable seat bodies. The motor 12 rotates the moving devices 14 of the covering device 16 with the help of a strap 22. The moving of the covering device 16 is performed at its both sides with the help of pincher rolls 14. The body 13 of the back rest and the body 17 of the extension 2 of the seat part 1 are joined to each other with the help of joint arms and the bar 21 combining them in such a way that the turning movement of the back rest moves to serve also as a turning movement of the extension 2 of the seat part 1.

A gutter device is shown in the FIG. 3 in order to collect the items that might drop from the user. Items used by the user might drop or end up between the seat part 1 and back rest 3 and between the body parts located at the sides. One way to prevent this is to locate gutters 28 which collect the items underneath the possible gaps or locate directing plates which direct the dropping items into a certain place where they can be easily detected.

Figure 5:
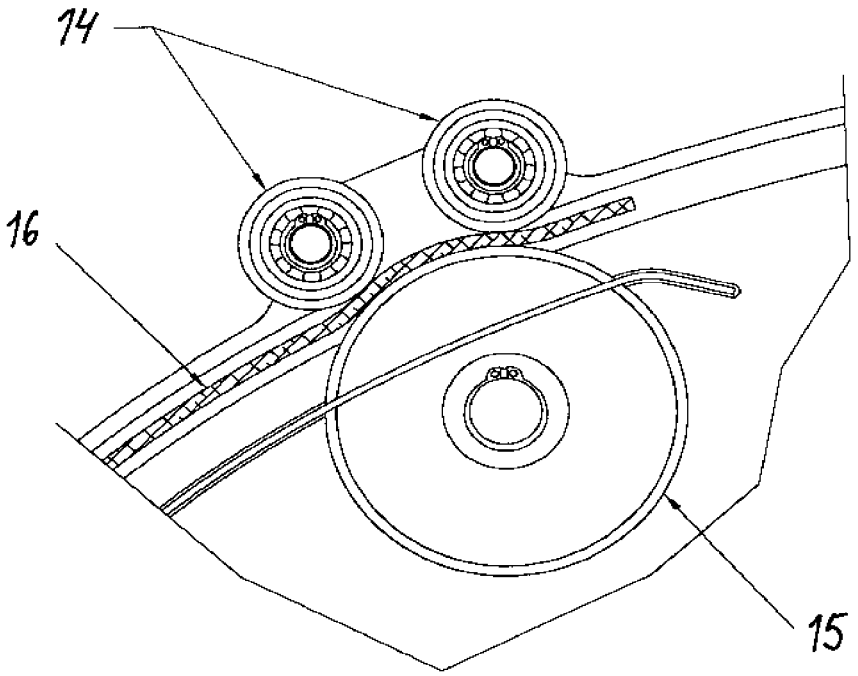
FIG. 5 shows a moving mechanism of the covering device.

In the FIG. 5 there is an example of moving of the covering device 16 with the help of power transmission directed from the motor. The power transmission belt 22 (FIG. 4) rotates the wheel 15 and support rolls 14 press the covering device 16 against the wheel 15. When the covering device 16 is made of flexible material, the mere friction is enough to move the covering device 16. In order to increase the friction some of the wheels 14, 15 may comprise low spikes or cross grooves or analogously cross handles.

Figure 6:
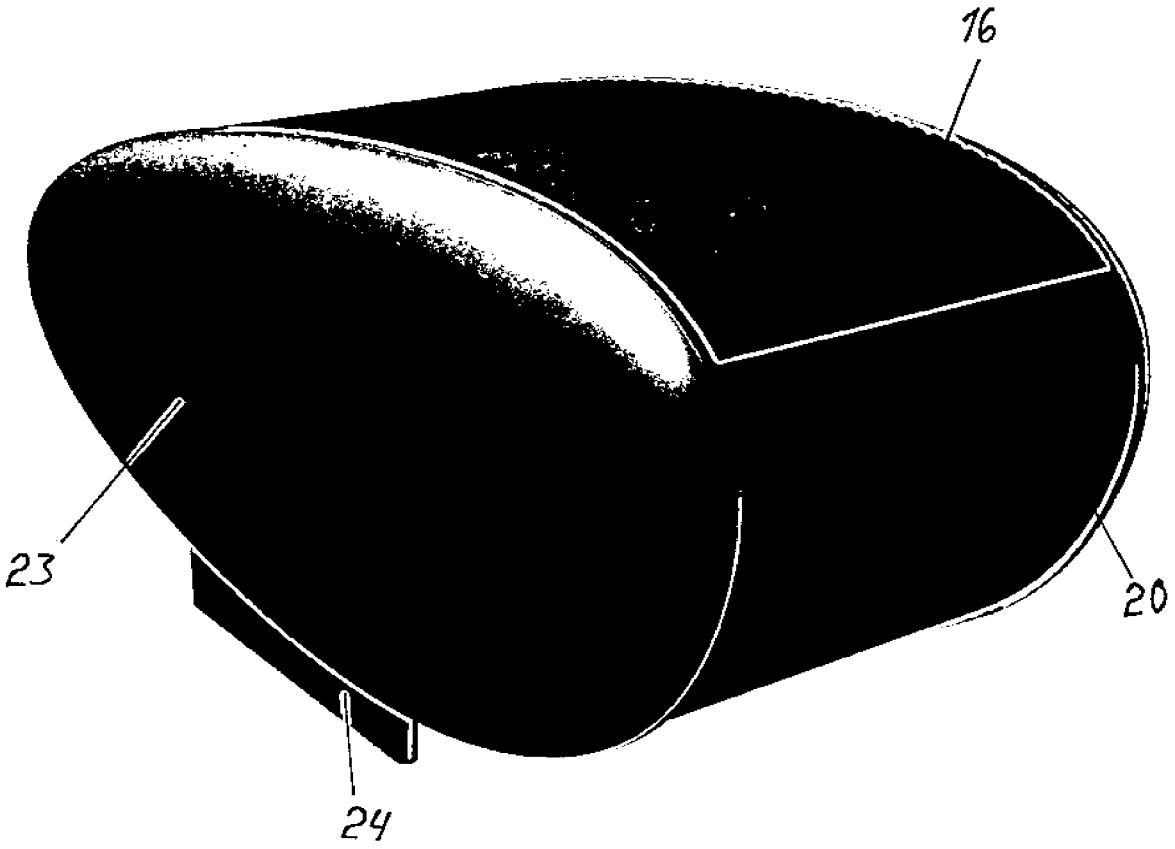
FIG. 6 shows the appearance model of the seat according to the invention when the covering device is closed.

FIG. 6 shows a seat in a closed resting space. Side covers 23 can be detached and in one way of performance they can also be changed to have a different form.

Figure 7:
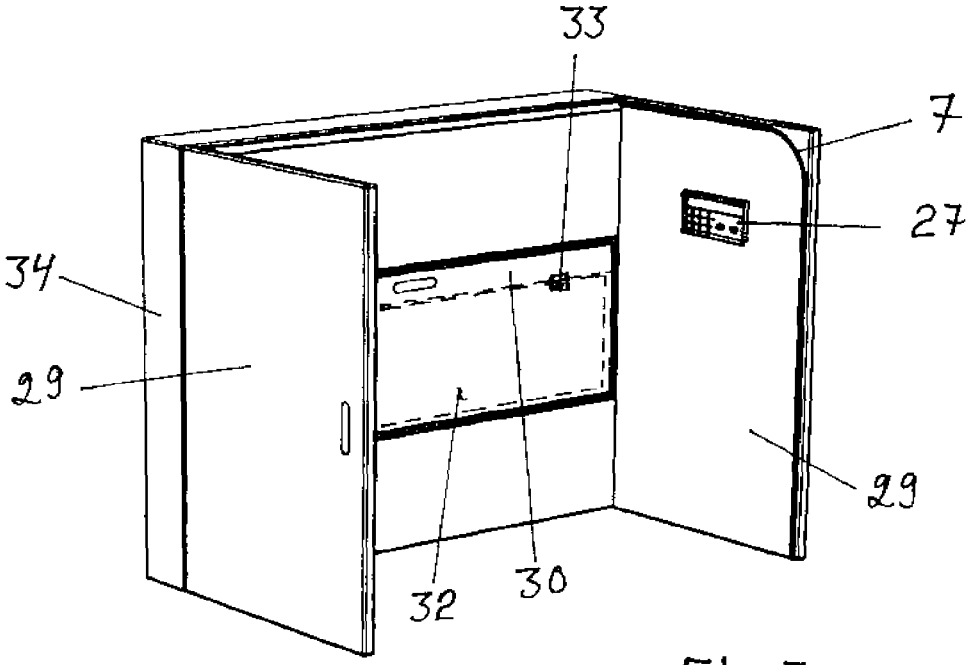
FIG. 7 shows a seat according to the invention which seat can be located at a wall.

The FIG. 7 shows a seat according to the invention located at a wall. The part 34 meant for the mechanisms is located closest to the wall. The seat part 30 which can be turned down from the wall and also serves as a resting surface comes out from behind the open doors 29. The doors 29 come open 90° in which case the seat part 30 can be turned down. Control elements such as control grooves 7 are attached to the doors 29 which control grooves control the covering device which comes out of the mechanism room located above which covering device can be pulled to cover the resting space formed by the back part 34 and the doors 29. A plate 32 is attached onto the surface of the seat part 30 with the help of hinges 33 which plate turns down according to the FIG. 2 when the seat part 30 is turning down in order to form a storage room 19 underneath the seat part 30. A control unit 27 is attached to a door 29 with the help of which door use charge is performed in which case the seat part 30 turns down to last for the paid time. Likewise the covering device can be pulled in order to cover the resting space.

Figure 8:
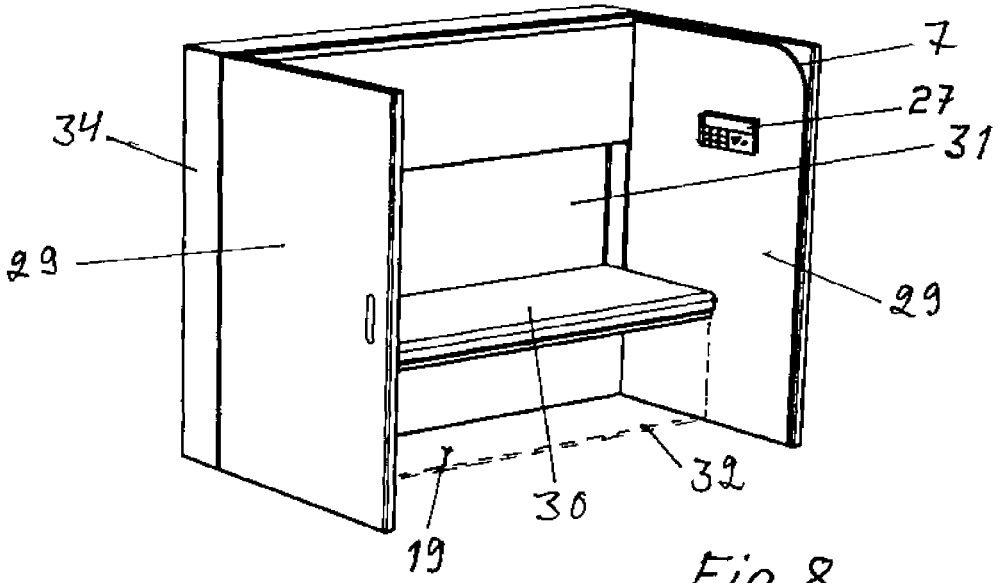
FIG. 8 shows a seat of the FIG. 7 when the sitting/resting surface is turned into a landscape orientation.

The control unit 27 allows the seat to have optional modes. It can be kept as a seat against the payment. The seat in the FIGS. 1-6 can lift the seat part 1 up automatically so that one cannot sit in it without payment. After performing the payment the user can choose various angles for the back rest 3. The covering device can be pulled to be a protection for the back rest 3 only when it is turned close to a horizontal plane. Regarding the seat according to the FIGS. 7 and 8 the covering device can be pulled to become a protection always when the seat is being used after payment.

The height of the side bodies of the seat according to the FIGS. 1-6 and the location height of the groove 7 of the covering device 16 can be so high that also regarding this seat the covering device 16 can be pulled to be a protection also when the sitting position is being chosen.

What is claimed is:

1. A seat comprising a seat part, a storage room under the seat part which is accessed only by lifting up the seat part, a covering device, two vertical plate elements located at a distance from each other, said seat part being adjusted between the plate elements, wherein the plate elements comprise grooves allowing the covering device to be moved forward for covering an area above the seat part thereby forming a closed space and back into an open state while being partly directed underneath the seat part, and a support plate at a back part of the seat for protecting the back part when the covering device has been moved forward for closing the space, wherein the covering device is comprised of a flexible material and stiffened in a crosswise direction with folds or by profiling.

2. The seat as claimed in claim 1, wherein the covering device is made of non-transparent material and insulates sound.

3. The seat as claimed in claim 1, wherein the covering device is made of a material which lets air go through.

4. The seat as claimed in claim 2, wherein the covering device is made of a material which lets air go through.

5. The seat as claimed in claim 1, wherein the seat comprises under the seat part a collecting system for items apt to drop by the user, the collecting system being configured to direct the dropping items into a desired location.

6. The seat as claimed in claim 2, wherein the seat comprises under the seat part a collecting system for items apt to drop by the user, the collecting system being configured to direct the dropping items into a desired location.

7. The seat as claimed in claim 3, wherein the seat comprises under the seat part a collecting system for items apt to drop by the user, the collecting system being configured to direct the dropping items into a desired location.

8. The seat as claimed in claim 4, wherein the seat comprises under the seat part a collecting system for items apt to drop by the user, the collecting system being configured to direct the dropping items into a desired location.

* * * * *